US006929378B2

(12) United States Patent
Wang

(10) Patent No.: US 6,929,378 B2
(45) Date of Patent: Aug. 16, 2005

(54) CHAIN-CONTROL DEVICE FOR SOLAR ROAD STUDS AND SOLAR ENERGY FLASH DEVICE

(76) Inventor: Mien-Hang Wang, No. 174, Tao-Te Road, Pa-Te City, Taoyuan Hsien (TW)

( * ) Notice: Subject to any disclaimer, the term of this patent is extended or adjusted under 35 U.S.C. 154(b) by 33 days.

(21) Appl. No.: 10/633,660

(22) Filed: Aug. 5, 2003

(65) Prior Publication Data

US 2005/0030739 A1 Feb. 10, 2005

(51) Int. Cl.[7] ..... E01F 9/00
(52) U.S. Cl. ..... 362/153.1; 362/183; 404/22
(58) Field of Search ..... 362/153.1, 183, 362/800, 231, 184, 234, 253, 145; 404/22, 84.5; 340/907

(56) References Cited

U.S. PATENT DOCUMENTS 5,613,799 A * 3/1997 Guide ..... 404/9
5,680,033 A * 10/1997 Cha ..... 359/542
2001/0055206 A1 * 12/2001 Liao et al. ..... 362/183
2004/0021580 A1 * 2/2004 Higgs ..... 340/908

FOREIGN PATENT DOCUMENTS

EP 0390749 A1 * 10/1990
GB 2075094 * 11/1981

* cited by examiner

*Primary Examiner*—John Anthony Ward
*Assistant Examiner*—Bao Q. Truong
(74) *Attorney, Agent, or Firm*—Birch, Stewart, Kolasch & Birch, LLP

(57) ABSTRACT

A chain-control device for solar road studs is provided to work by using a plurality of solar cells to convert solar energy into electric energy during daytime and store it in a battery unit, so that they can flash in nighttime for traffic security purpose or gardening deposition. The primary merit of the present invention is, first of all, free of wiring job, no need of city power, good conformity with environment protective conditions. Because of a successful chain control function, the existing random flash performance could be substituted with an interactive chain control flash or a synchronous flash performance, which is also applicable to gardening for fancy flash performance.

15 Claims, 6 Drawing Sheets

CHAIN-CONTROL DEVICE FOR SOLAR ROAD STUDS AND SOLAR ENERGY FLASH DEVICE

BACKGROUND OF THE INVENTION

1. Field of the Invention

The present invention relates to a chain-control device for solar road studs, which is capable of setting road studs into an interactive chain-control state for presenting a simultaneous or fancy flash, as well as a solar energy flash device.

2. The Prior Arts

Solar road studs are usually disposed on the shoulders and the median of a highway, which, particularly in our local areas, would rather flash randomly than synchronously or interactively.

As the shoulders and the median of road can be viewed more clearly, to flash the road studs synchronously or interactively is preferred. Taking the local solar road studs for instance, the flash period of each road stud is 0.5 seconds approximately. However, there is no time interval regulated between one stud to the next, which could be any value from 0.3 seconds to 1 second according to different tolerances of different components and charged electricity quantity of batteries. To our opinion, a good timing sequential flash of chain-control mechanism would be preferred, which could be done usually by triggering one after another in sequence.

A solar flash system is basically a wireless system needing no wiring job or city power. For achieving the chain control purpose, the control signals could be carried by IR (Infra-Red) ray or RF (Radio Frequency) signals.

The appearance of a shoulder's road stud 21 is shown in FIG. 1, in which an IR receiver commonly applied in a generic electric home appliance, such as a remote controller for TV set or video recorder, is adopted on account of its cost, noise resistivity, and power consumption. An example is TSOP1838SS3V of VI_SHAY, which has a working voltage of 3V, an IR carrier signal at 38 KHz, and a high enough sensitivity to IR for receiving a signal radiated from as distant as 35 m away, and a fast response ability for receiving a signal in 1 msec.

SUMMARY OF THE INVENTION

The present invention relates to a chain-control device for solar road studs, in which solar cells are employed to convert solar energy into electric energy in daytime and stored in a battery unit, so that those road studs can flash in nighttime for traffic security purpose or gardening deposition. The present invention needs no wiring job or city power, and it can well conform with environment protective conditions. Unfortunately, however, the existing flash devices flash randomly, they do not provide a chain control flash style.

Therefore, the primary object of the present invention is to provide a chain-control device for solar road studs, which requires no wiring job and flashes interactively in a chain-control operation.

Another object of the present invention is to provide a free-of-wiring-job chain-control device for solar road studs, in which the chain control signals are transmitted by IR or RF carrier waves, and the encoded digital control signal may comprise control instructions, flash instructions, color-control instructions, remote control setting instructions, and sovereignty transfer instructions.

Yet, another object of the present invention is to provide a chain-control device for solar road studs, in which a flash device, when it starts to flash, will trigger a next road stud and so on such that a chain-control flash could be made to show a lighting point sliding along the median and shoulders distinctly.

A further object of the present invention is to provide a solar energy flash device.

For more detailed information regarding advantages or features of the present invention, at least an example of preferred embodiment will be described below with reference to the annexed drawings.

BRIEF DESCRIPTION OF THE DRAWINGS

The related drawings in connection with the detailed description of the present invention to be made later are described briefly as follows, in which.

DETAILED DESCRIPTION OF THE PREFERRED EMBODIMENT

Figure 1:
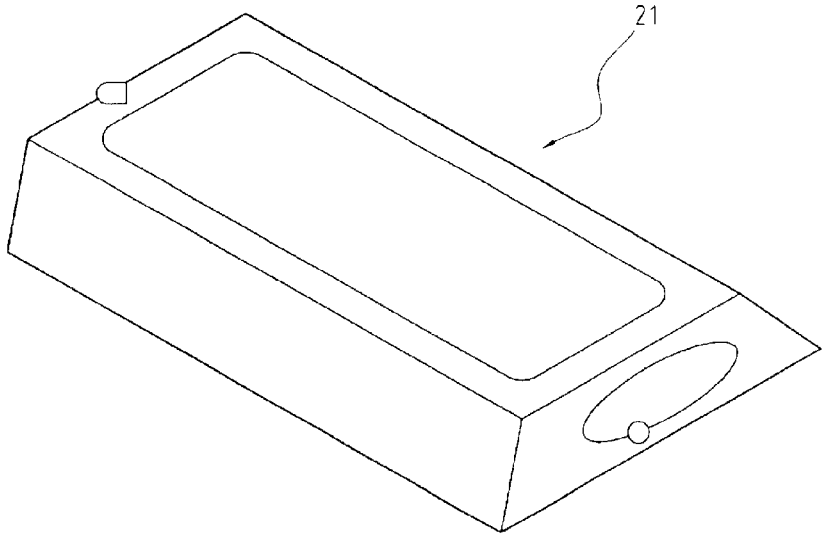
FIG. 1 shows the appearance of a solar road stud on road shoulder.
Figure 2:
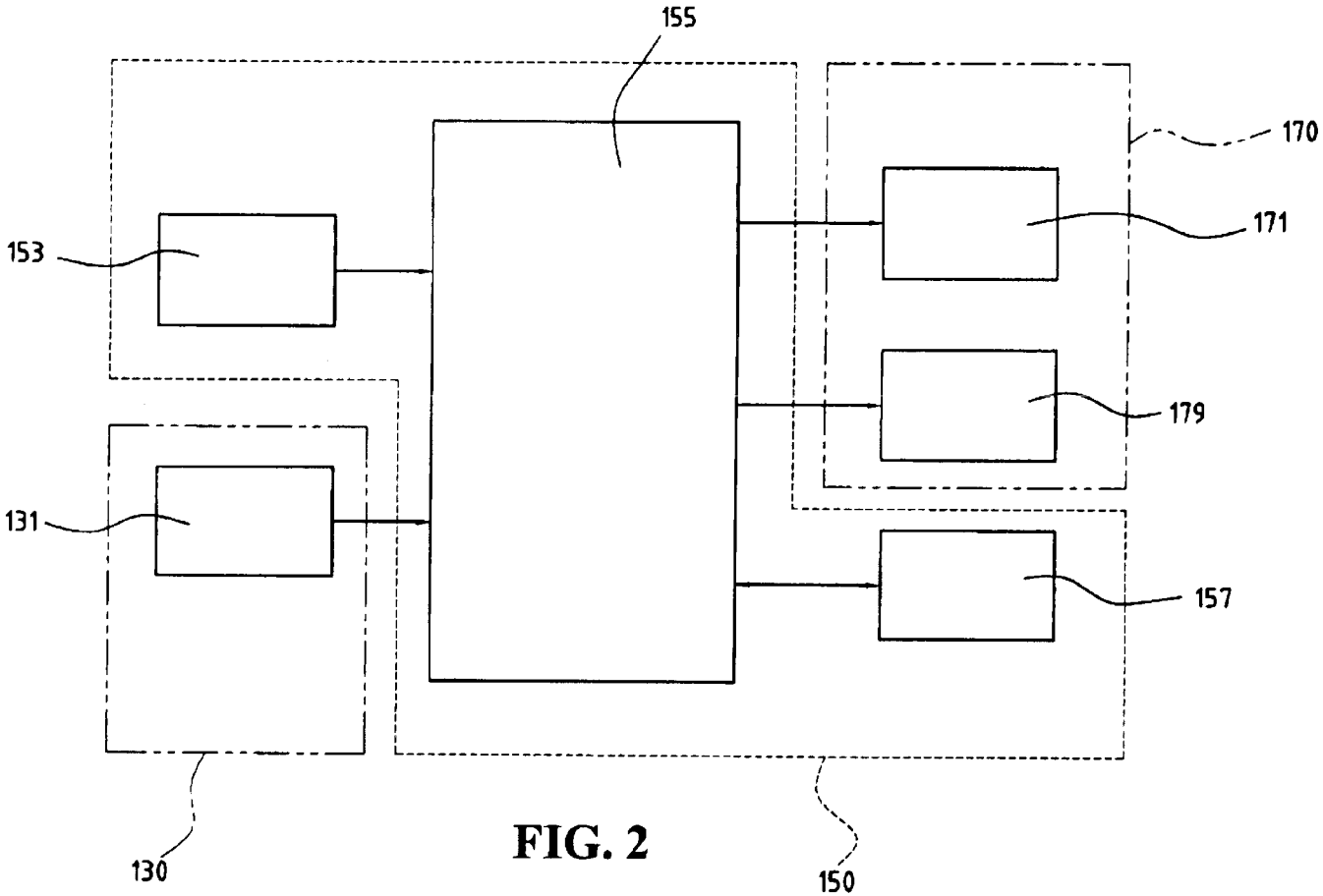
FIG. 2 shows the internal configuration of the solar road stud of the present invention.

The present invention relates to a chain-control device for solar road studs, as well as a solar energy flash device. In a road stud system related to the present invention, a plurality of road studs is driven and controlled to flash synchronously or in fancy styles by a chain control technology. Each road stud shown in FIG. 2 comprises an input device 130 for receiving IR or radio encoded digital flash control signals; a processing device 150 for receiving the flash control signals delivered from the input device 130, controlling flash, and executing commands according to different encoded control instructions; and an output device 170 for receiving flash style from the processing device and outputting a flash control signal by means of RF or IR carrier.

The road studs are supposed, under a linear or two-dimensional disposition, to present a synchronous flash or a fancy flash performance regularly, in which the fancy flash is mostly applied for gardening creative purposes in two dimensions, in which each road stud is provided with an ordinal number and a predetermined time interval between flashes and flash colors to present different flash effects by a sovereignty transfer instruction.

Moreover, the input device 130 in an interactive chain control device for solar road studs is substantially a front-end signal receiver 131 for receiving IR or radio carrier frequencies.

Yet, the processing device 150 further comprises a power supply unit 153 for supplying electric power to the processing device, a microprocessor unit 155 for determination of the flash style by availing the power supplied by the power supply unit, a memory unit 157 for the microprocessor unit 155 to fetch data of a specified flash style.

Yet, the power supply unit 153 further comprises a solar cell-board unit 156 for transferring solar energy into electric energy, and a battery unit 158 for storing the electric energy delivered from the solar cell-board unit 156 and outputting a first control signal for judging whether it is now in daytime or nighttime. The memory unit 157 could be an EEPROM (Electrically Erasable Programmable Read-Only Memory) employed to store the parameters of working manners of the road stud, flash intervals, fancy flash styles, ordinal numbers, and colors.

Yet, the output device 170 for transmitting flash control signals by means of RF or IR carrier further comprises a rear-end signal transmitter 171, which could be an IR emission diode or RF transmitter, for outputting the flash control signals; and a light-emitting diode 179, in which a monochrome diode is applied for a generic road stud and a RBG diode unit is applied to gardening arts for offering people with a splendid and color-enriched impression.

Yet, the input device 130, which is a front-end signal receiver 131, could be a TSOP1830SS3V of VISHAY to be worked at 3 V.

Yet, the microprocessor unit 155 is substantially a microprocessor, and in this case, a PIC12CE518 of MICROCHIP having a built-in EEPROM and SLEEP MODE function for energy saving is adopted.

Figure 3:
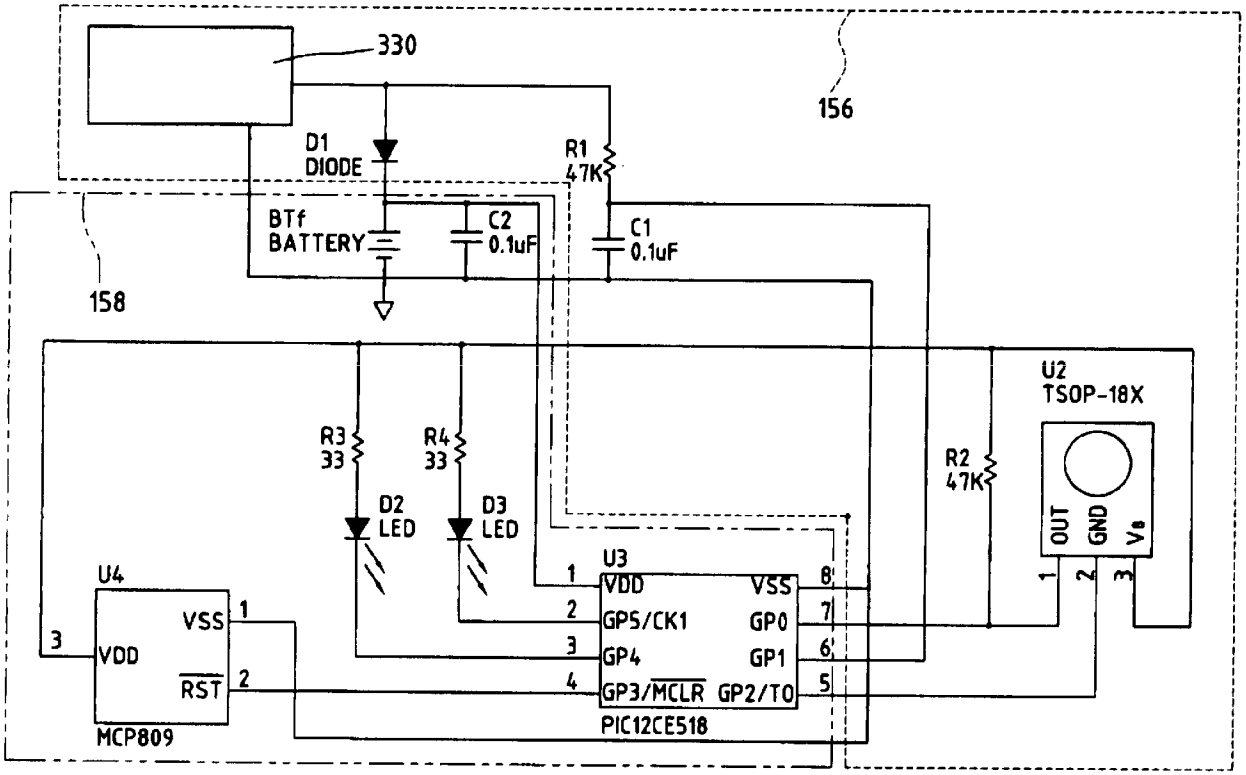
FIG. 3 shows a linearly disposed IR-control detailed circuit.

FIG. 3 shows a linearly disposed IR-control detailed circuit. The circuit is comprised of a solar cell-board unit 330 for transferring received solar energy into electric energy, and a battery unit 333. In this circuit, the solar cell-board unit 330 is supposed to charge the battery through a diode D1; after pin GP1 of the microprocessor PIC12CE518 outputs LOW to have a capacitor C1 discharged, the pin GP1 is turned to be an input end with a high impedance to detect the solar cells through a resistor R1; then, the microprocessor shall go judging whether it is now in daytime or not by detecting the charging state of the capacitor C1, if positive, C1 is charged gradually, otherwise the microprocessor should prepare to flash.

By the way, an auxiliary IC MCP809 of Microchip is also provided to inspect the power voltage to keep the microprocessor working smoothly. A second pin GND of the IR receiver TSOP18X of VISHAY is connected with pin GP2 of the microprocessor. In the duration between two flashes, the microprocessor would enter a SLEEP MODE to consume current in 2 $\mu$A only to lower down the power consumption, and the receiver might be shut down then and there and reopened at the moment the microprocessor is supposed to receive a flash trigger signal so that more power consumption can be saved. Also, in the microprocessor, pin GP5 outputs LOW to lighten an LED D3, while GP4 outputs LOW to lighten an IR LED D2.

The related flash parameters are stored in the EEPROM of the microprocessor. The operating highlights are summarized as the following:

(1) A flash period may be set at 0.5 seconds for example. The microprocessor is requested to flash repeatedly by this period on it's own before a flash control signal is detected and received.

(2) A detection time for detecting a flash control signal may be set at 0.4 seconds for example. It is meant to detect for the next flash control signal by the end of an elapsed 0.4 seconds after a previous flash is finished, while the microprocessor would enter the SLEEP MODE before the critical 0.4 seconds for saving power consumption.

(3) An ending time for receiving a flash control signal may be set at 0.55 seconds for example. As mentioned above, the microprocessor is requested to flash on it's own by the period of 0.5 seconds if no flash control signal is available, and after a predetermined times to have no flash control signal received, the receiving function is opened once more continuously to obtain the synchronism. Hence, every flash device may serve for an initial flash device to perform a synchronous control and maintain the power-consumption saving function.

(4) A serial number is offered to every flash device. Therefore, it is possible to effect a flash style made by the odd-numbered flash devices and the even-numbered flash devices alternately.

(5) The flash device works either in a chain flash style or a synchronous flash style, in which, under the chain flash style, a flash device flashes upon receipt of a chain-control signal and meanwhile forwards a chain-control signal to the next flash device to perform the same; while, under the synchronous flash style, upon receipt of a flash control signal, a flash device would transmit the same immediately to the next flash device in recursion (plus 1), then the microprocessors will calculate and compensate the time delayed to therefore perform a synchronous flash.

(6) If desired, there can be other parameters.

In regard to the setting procedure of the flash device parameters, detailed description is made below.

Figure 4:
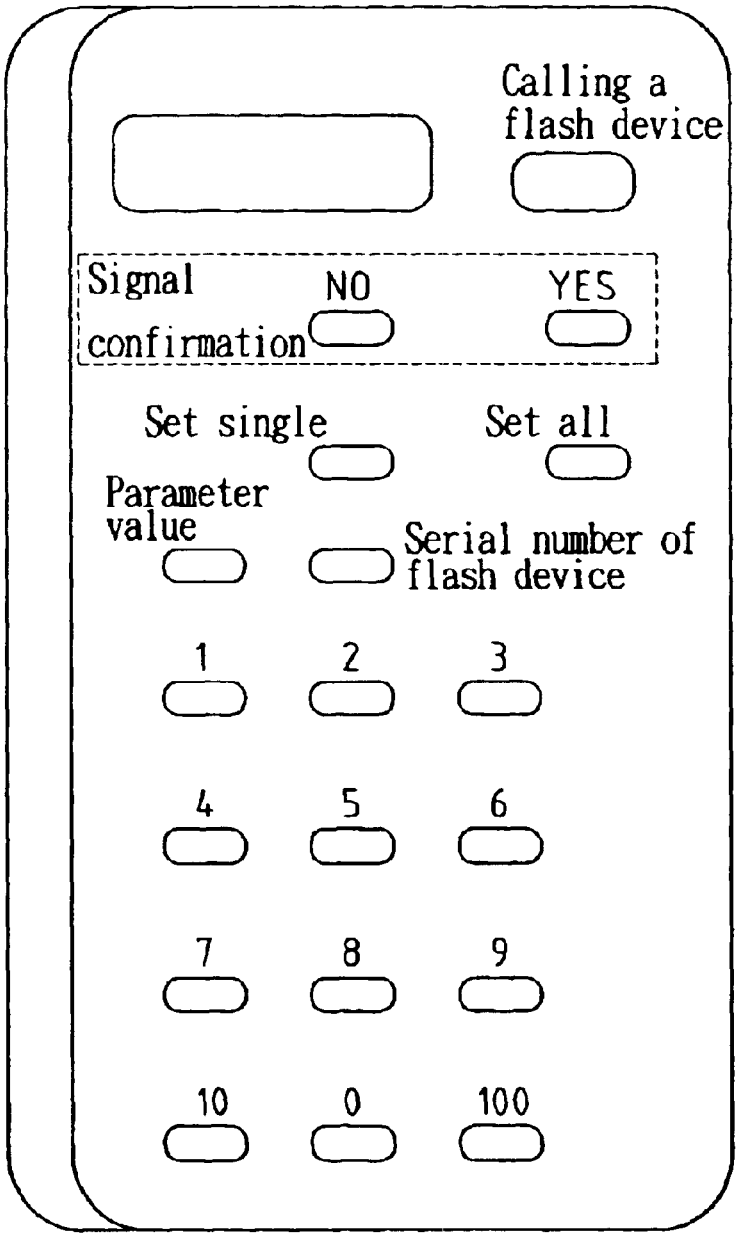
FIG. 4 shows the key distribution of a remote controller.

In every road stud, the flash style parameters could be preset in the EEPROM by maker or set on site. Because an IP or RF receiver is arranged in each road stud, therefore, it is possible to set the parameters with a remote controller shown in FIG. 4, without increasing the cost.

For setting a single one or all the road studs with a remote controller, the interaction between the remote controller and every corresponding road stud is described below.

First, a user has to make sure that a road stud to be set is in the stand-by state; then, depress a key "calling a flash device". The road stud starts to flash in a time interval of 0.5 seconds for example, upon receipt of the signal "calling a flash device" sent from the remote controller. The road stud would return to the stand-by state again in the event that no "Yes" signal is received from the remote controller within 5 seconds afterwards, or the road stud would flash repeatedly with the time interval of 0.5 seconds if the "Yes" signal is received within 5 seconds as expected.

In the next step, the user may choose to set all the road studs or a single one.

If setting all the road studs is desired, the user has to first depress in sequence a key "Set all", "Parameter", parameter value "nnn", then "Confirmation (Yes)". The remote controller will send all the parameters out, and this time each the road stud will flash rapidly with a time interval shorter than 0.5 seconds. This action continuous until all the data is stored, and then, the road studs begin to flash with the time interval of 0.5 seconds.

On the contrary, if setting a single road stud is desired, the user needs to depress in sequence a key "Set single", "serial number of stud", "Parameter", parameter value "nnn", then "Confirmation (Yes)". A road stud to be set having a serial number corresponding to code sent by the remote controller will receive and update the parameter value (nnn). At this time, this road stud will flash rapidly with a time interval shorter than 0.5 seconds, which is then changed into 0.5 seconds after the data received is stored.

In addition, the depositing and mounting method of the interactive chain-control devices of solar road studs is suggested to perform according to the following steps:

The first step is a step for deciding a linear or a two-dimensional deposition.

The second step is a step for installing a plurality of road studs according to the chosen deposition.

The third step is a step for deciding the flash style.

The fourth step is a step for setting the working parameters to the road studs with a remote controller.

First Example for Road Security Studs

The system is controlled by IR in unidirectional receiving and unidirectional transmitting.

Figure 5:
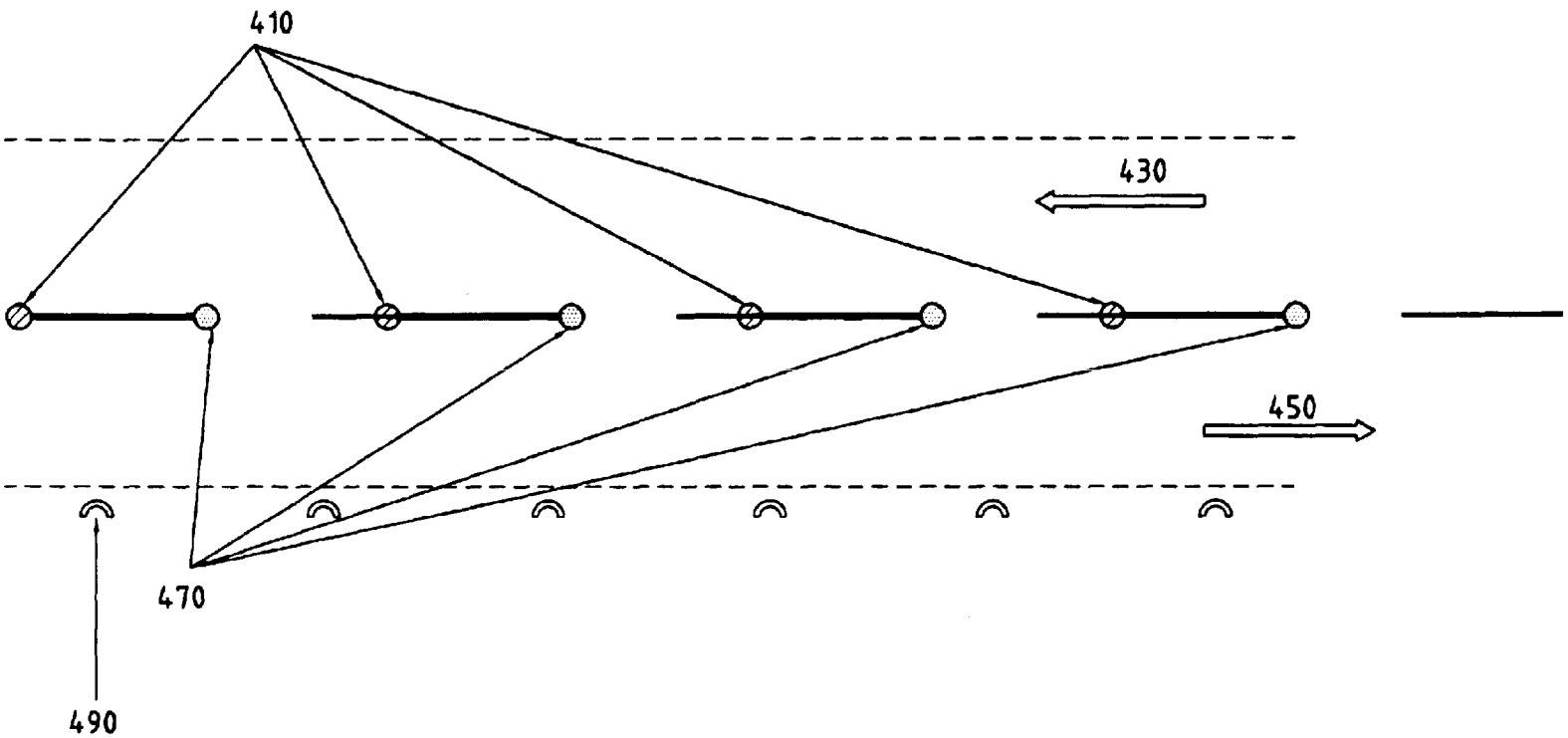
FIG. 5 is a linear distribution diagram.

In the linear deposition shown in FIG. 5, two dotted lines rep resent the roadsides 490 (the shoulders); a string of road studs is mounted in the median and defined as the median studs, which are divided into odd-numbered and even-numbered median studs and interpolated intermittently, in which the even-numbered studs 410 are arranged to receive the flash control signals from the right to the left 430, while the odd-numbered studs 470 are arranged to receive the flash control signals from the left to the right 450.

The foregoing arrangement of the odd-numbered and the even-numbered median studs may be inversely arranged.

The intermittently interpolated median studs could be fully viewed by the wagon flow from the right to the left and vice versa to show meaningful directions and paths for signal transmission.

Besides, there is a string of road studs aligned on a top end of the road, which is defined as shoulder studs, in which the shoulder studs on the top end will receive the flash control signals in the same direction with the wagon flow, which directs to the left from the right. Also, there is another string of road studs aligned on a bottom end of the road, which is defined as shoulder studs too, in which the shoulder studs on the bottom end will receive the flash control signals in the same direction with the wagon flow, which directs to the right from the left.

Second Example for Gardening Deposition

Figure 6:
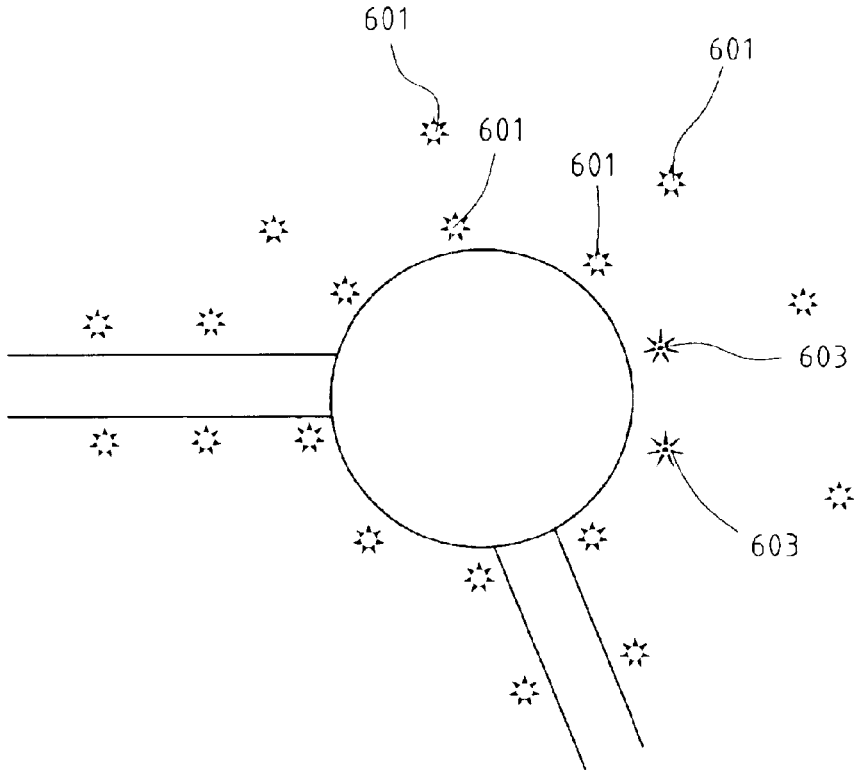
FIG. 6 is a two-dimensional distribution diagram.

A plurality of flash devices in accordance with the present invention is installed in two dimensions as shown in FIG. 6.

As illustrated in FIG. 6, a circular center space is a landscape-viewing section, which is provided on two sides with respective aisles and a plurality of flash marking devices 601 interspersed in a substantially two-dimensional distribution, in which two asterisk symbols 603 represent the flash markings radiating flash control signals.

In gardening arts, the direction-indiscriminating RF control signal is more effective in a larger scope than that of IR. Therefore, it is possible to locate a RF transmitter in a center position of a garden for controlling all flash devices mounted therein.

In the above described, at least one preferred embodiment has been described in detail with reference to the drawings annexed, and it is apparent that numerous changes or modifications may be made without departing from the true spirit and scope thereof, as set forth in the claims below.

What is claimed is:

1. A chain-control device for solar road studs comprising a plurality of flash markings for performing interactive chain control to present a synchronous flash or a fancy flash performance, in which each road stud includes:

an input device for receiving a flash control signal;

a processing device for deciding the flash style according to the flash control signal relayed from the input device; and an output device for outputting the flash control signal according to the flash style decided by the processing device so that the flash markings are enabled to present the regular synchronous flash or the fancy flash performance in linear or two-dimensional deposition.

2. The chain-control device according to claim 1, wherein the interactive chain control presents the synchronous flash performance.

3. The chain-control device according to claim 1, wherein the interactive chain control presents the fancy flash performance.

4. The chain-control device according to claim 3, wherein the fancy flash is created by a predetermined value.

5. The chain-control device according to claim 1, wherein the input device is a front-end signal receiver.

6. The chain-control device according to claim 1, wherein the processing device further comprises:

a power supply unit for providing electric power to the processing device;

a microprocessor unit for deciding the flash style; and a memory unit for storing data from or providing data to the microprocessor unit.

7. The chain-control device according to claim 6, wherein the power supply unit further comprises:

a solar cell-board unit for converting solar energy into electric energy; and a battery unit for storing the electric energy of the solar cell-board unit and outputting a first control signal.

8. The chain-control device according to claim 7, wherein the microprocessor unit would judge whether it is daytime or nighttime based on the first control signal.

9. The chain-control device according to claim 6, wherein the memory unit stores at least parameters of: working style of the flash markings, time interval between two neighboring flashes, changing manner of the fancy flash performance including alignment, and color.

10. The chain-control device according to claim 9, wherein the memory unit is an electrically erasable programmable read-only memory.

11. The chain-control device according to claim 1, wherein the output device further comprises:

a rear-end signal transmitter for outputting the flash control signal; and a flash light-emitting diode for emitting colorful flashes.

12. The chain-control device according to claim 11, wherein the flash control signal is carried by radio frequency waves.

13. The chain-control device according to claim 11, wherein the flash control signal is carried by infrared ray.

14. The chain-control device according to claim 9, wherein the parameters of the flash markings are set by an infrared remote controller.

15. The chain-control device according to claim 9, wherein the parameters of the flash markings are set by a radio frequency remote controller.

* * * * *